US011350716B2

(12) United States Patent
Beeler

(10) Patent No.: US 11,350,716 B2
(45) Date of Patent: Jun. 7, 2022

(54) ELECTRONIC DEVICE CASE WITH INTERNAL HOOKS AND METHOD OF USE

(71) Applicant: Stephen M. Beeler, Terre Haute, IN (US)

(72) Inventor: Stephen M. Beeler, Terre Haute, IN (US)

( * ) Notice: Subject to any disclaimer, the term of this patent is extended or adjusted under 35 U.S.C. 154(b) by 0 days.

(21) Appl. No.: 16/993,928

(22) Filed: Aug. 14, 2020

(65) Prior Publication Data

US 2021/0298438 A1 Sep. 30, 2021

Related U.S. Application Data

(60) Provisional application No. 62/993,752, filed on Mar. 24, 2020.

(51) Int. Cl.
*A45C 11/00* (2006.01)
*A45F 5/00* (2006.01)

(52) U.S. Cl.
CPC ..... *A45C 11/00* (2013.01); *A45C 2011/002* (2013.01); *A45C 2200/15* (2013.01); *A45F 2200/0516* (2013.01)

(58) Field of Classification Search
CPC ..... A45C 2011/002; A45C 2011/003; A45F 2200/0516
USPC ..... 224/929, 930, 560, 268, 269; 248/303, 248/339
See application file for complete search history.

(56) References Cited

U.S. PATENT DOCUMENTS 2,842,277 A * 7/1958 Jewell ..... A61M 5/1417 215/399
2,856,111 A * 10/1958 Wolfe ..... F41C 33/007 224/268
3,627,177 A * 12/1971 Marcus ..... A61M 5/1417 222/181.3
3,768,684 A * 10/1973 Buchtel ..... B65D 25/22 215/399
3,883,024 A * 5/1975 Thomas ..... A61M 5/1417 215/399
3,998,360 A * 12/1976 Mack ..... E03D 9/033 222/181.1
4,883,175 A * 11/1989 Thiele ..... G11B 23/023 206/393
5,743,451 A * 4/1998 Kahn ..... A45F 5/021 224/268
5,938,137 A 8/1999 Poulson
(Continued)

OTHER PUBLICATIONS

Amazon.com, IPad Mini Case for Kids—IPad Mini Headrest Mount With Detachable Hanging Hooks, Mar. 3, 2020.
(Continued)

*Primary Examiner* — Justin M Larson
(74) *Attorney, Agent, or Firm* — Overhauser Law Offices, LLC

(57) ABSTRACT

An electronic device case with internal hooks that allow an electronic device to hang from the hooks without increasing the thickness of the case. Multiple hooks or attachment members can be used in one case or one attachment member can be utilized. The hooks can be extended and twisted to be locked into a position that is perpendicular to the case, which allows the case to either hang from the hooks or stand upright with the hooks acting as a base. The hooks can also be rotated to be in line with the edge of the case and stored within the case when not in use.

6 Claims, 5 Drawing Sheets

(56) References Cited

U.S. PATENT DOCUMENTS

| | | | | |
|---|---|---|---|---|
| 7,111,364 | B2 * | 9/2006 | Bader | B25F 5/02 16/110.1 |
| 7,175,143 | B1 * | 2/2007 | Ho | A47G 29/083 248/215 |
| 7,232,105 | B2 * | 6/2007 | Want | A61G 7/0503 128/DIG. 24 |
| 7,286,803 | B2 * | 10/2007 | Hamasaki | A45F 5/00 224/217 |
| 7,429,024 | B2 * | 9/2008 | Boklund-Moran | A47G 29/083 16/429 |
| 7,740,222 | B2 * | 6/2010 | Wang | F16M 13/022 248/691 |
| 8,002,225 | B1 * | 8/2011 | Malone | A47B 81/00 248/214 |
| 8,096,517 | B1 * | 1/2012 | Hamilton | B60N 3/005 248/308 |
| 8,374,661 | B2 * | 2/2013 | Fratti | A45F 5/02 224/462 |
| 8,636,183 | B1 | 1/2014 | Steiner | |
| 9,876,885 | B1 * | 1/2018 | Velasquez | H04B 1/3888 |
| 9,985,678 | B1 * | 5/2018 | Sumida | H04M 1/04 |
| 10,003,681 | B1 * | 6/2018 | Hsu | H04M 1/06 |
| 10,413,027 | B1 * | 9/2019 | Olson | F16M 11/14 |
| 10,856,633 | B2 * | 12/2020 | Stagge | H04B 1/3877 |
| 11,083,263 | B2 * | 8/2021 | Reyes | F16M 13/022 |
| 11,132,021 | B2 * | 9/2021 | Diehl | H05K 5/00 |
| 2008/0169411 | A1 * | 7/2008 | Quinn | A47K 10/32 248/691 |
| 2010/0001165 | A1 | 1/2010 | Huang et al. | |
| 2010/0072334 | A1 | 3/2010 | Le Gette et al. | |
| 2010/0267431 | A1 * | 10/2010 | Fratti | A45F 5/02 455/575.6 |
| 2011/0309117 | A1 * | 12/2011 | Roberts | H04M 1/04 224/217 |
| 2012/0025039 | A1 | 2/2012 | Segal | |
| 2014/0124521 | A1 * | 5/2014 | Brown | H05K 5/03 220/756 |
| 2014/0332418 | A1 | 11/2014 | Cheung et al. | |
| 2015/0163929 | A1 * | 6/2015 | Wang | H05K 5/023 361/679.01 |
| 2018/0041237 | A1 | 2/2018 | Mody et al. | |
| 2020/0083921 | A1 * | 3/2020 | Hogue | A45F 5/00 |

OTHER PUBLICATIONS

Palmweavers.net, Venora Galaxy Note 9 Case 360 Degree Rotatable Ring Stand and Ring Holder Kickstand Fit Magnetic Car Mount Slim Soft Protective Case Cover, Mar. 3, 2020.

Etsy.com, Purple Leather iPhone Snap on Handling Built-in Stand with Wristlet hook, iPhone Wallet Credit Card Case, Mar. 4, 2020.

* cited by examiner

ELECTRONIC DEVICE CASE WITH INTERNAL HOOKS AND METHOD OF USE

CROSS REFERENCE TO RELATED APPLICATIONS

This application claims the benefit of U.S. Provisional Application No. 62/993,752 filed Mar. 24, 2020.

FIELD OF THE INVENTION

The present invention relates to electronic device cases, and in particular, electronic device cases with internal hooks and a method of use.

BACKGROUND

This invention relates to electronic device cases with internal hooks. Many electronic device users utilize soft or hard shell protective cases to protect their cell phones or other electronic devices. Currently many electronic devices and cases for electronic devices can be fit with auxiliary parts to allow a user to hang or hold the device in an easier manner. However, those devices are typically complex, bulky, and can be difficult to maintain on the device or case via adhesive.

It is therefore desirable to provide a case for an electronic device with internal provisions to hang the device or allow the device to stand.

SUMMARY OF THE INVENTION

One object of the present invention is to allow an electronic device to hang from an attachment member without adding a bulky auxiliary part to a case surrounding the electronic device. Multiple attachment members can be used in one case or one attachment member can be utilized. In one embodiment the attachment member can be in the shape of a hook. The hooks can be extended and twisted to be locked into a position that is perpendicular to the case, which allows the case to either hang from the hooks or stand upright with the hooks acting as a base. The hooks can also be rotated to be in line with the edge of the case and stored within the case when not in use.

DETAILED DESCRIPTION

Figure 3:
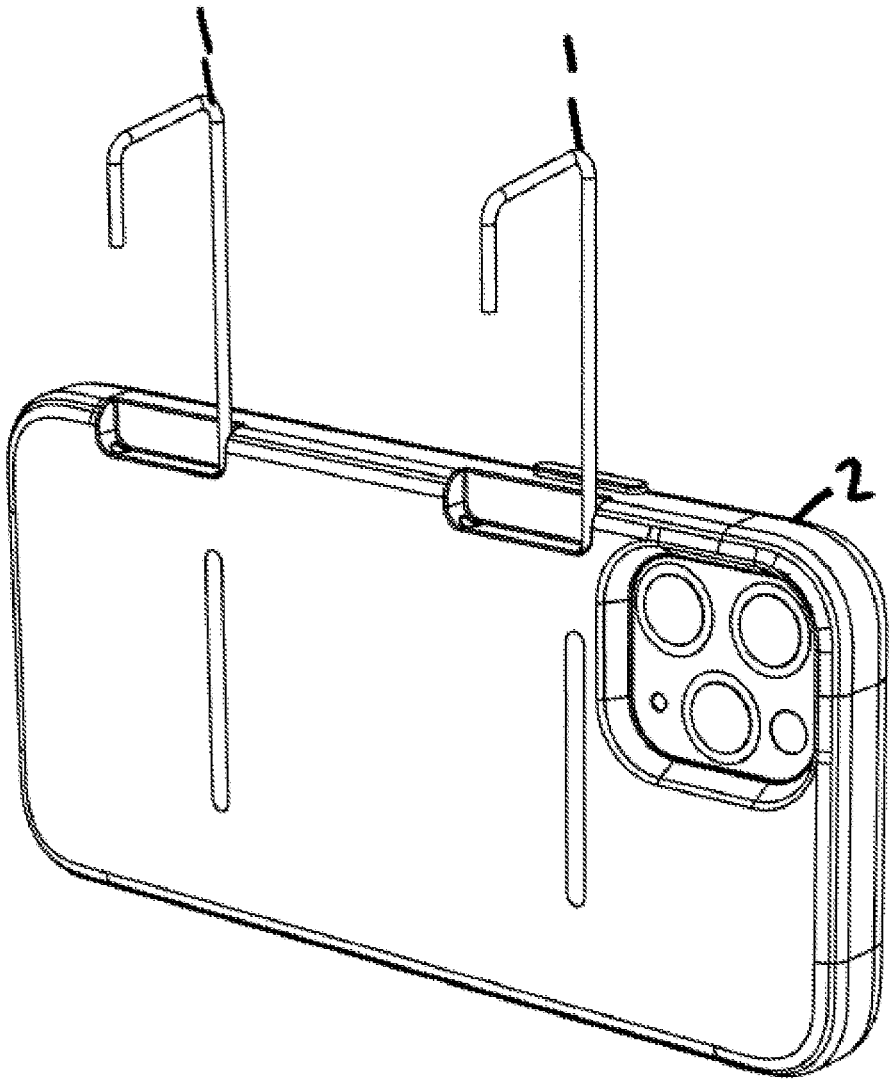
FIG. 3 shows a perspective view of an electronic device case with two rotatable hook members rotated perpendicular to the case and extended from the core of the case.
Figure 4:
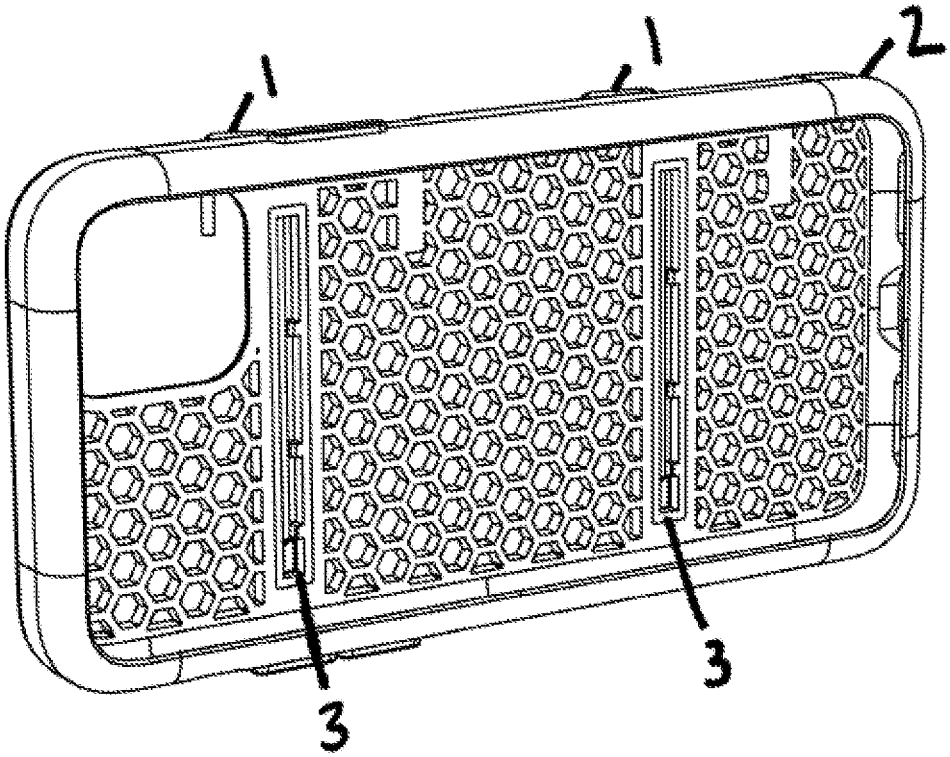
FIG. 4 shows the interior of an electronic device case with two rotatable hook members rotated parallel to the case.
Figure 5:
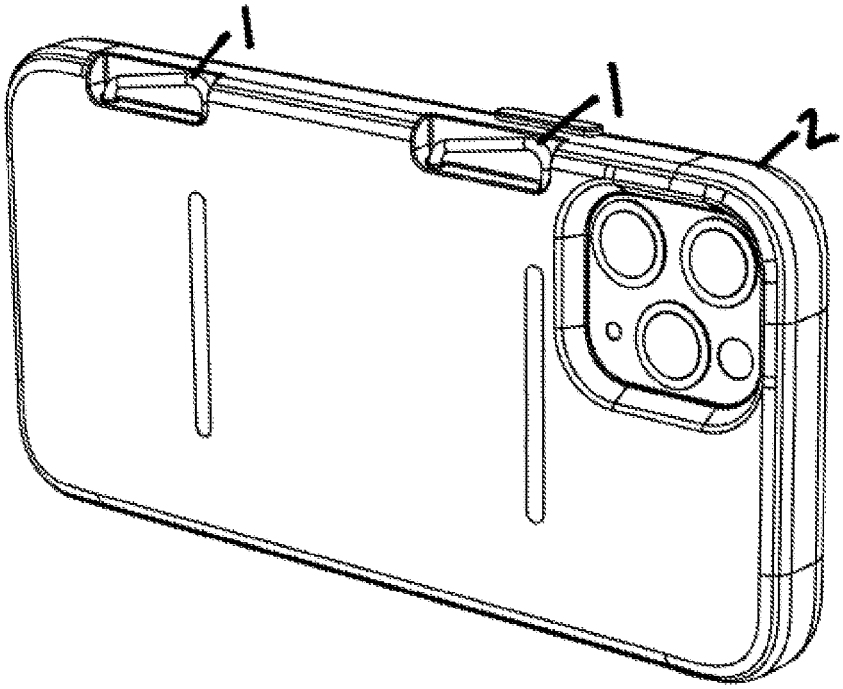
FIG. 5 shows the rear side of an electronic device case with two rotatable hook members rotated parallel to and stored within the case.
Figure 8:
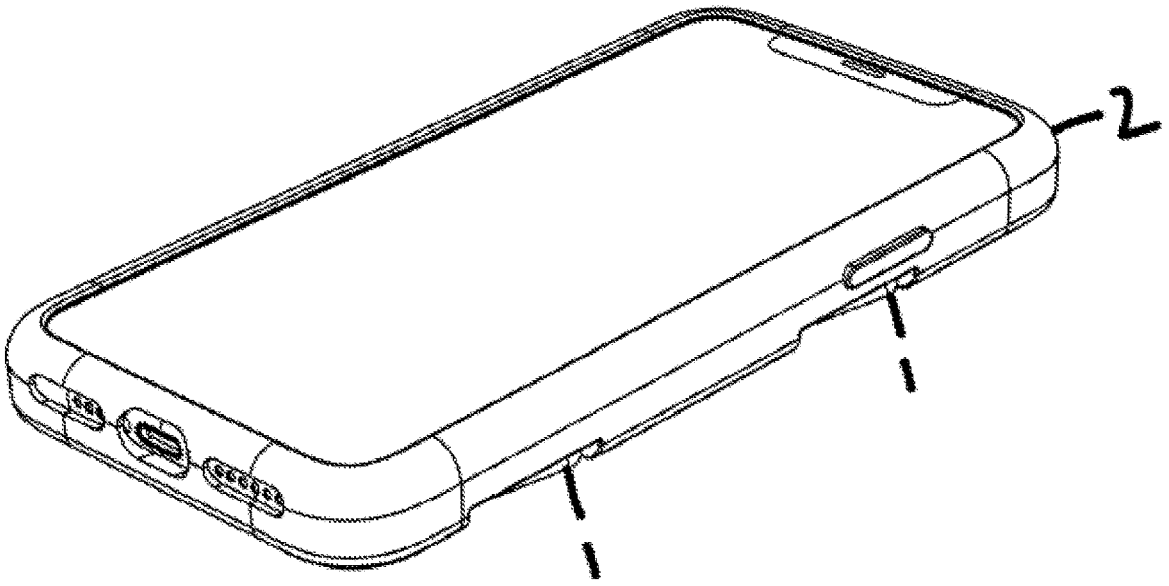
FIG. 8 shows a perspective top view of an electronic device within an electronic device case with two rotatable hook members rotated parallel to and stored within the case.

The present invention provides an electronic device case 2 with at least one internal attachment member 1. The case 2 will accommodate an electronic device in a shape surrounding a rear surface and side surfaces of the electronic device as shown in FIG. 8. As shown in FIGS. 2 and 5, the attachment members 1, having a top end and a bottom end, are fully contained within the case 2. The attachment members 1 shown in FIGS. 1-6 and 8 are thin metal hooks.

Figure 1:
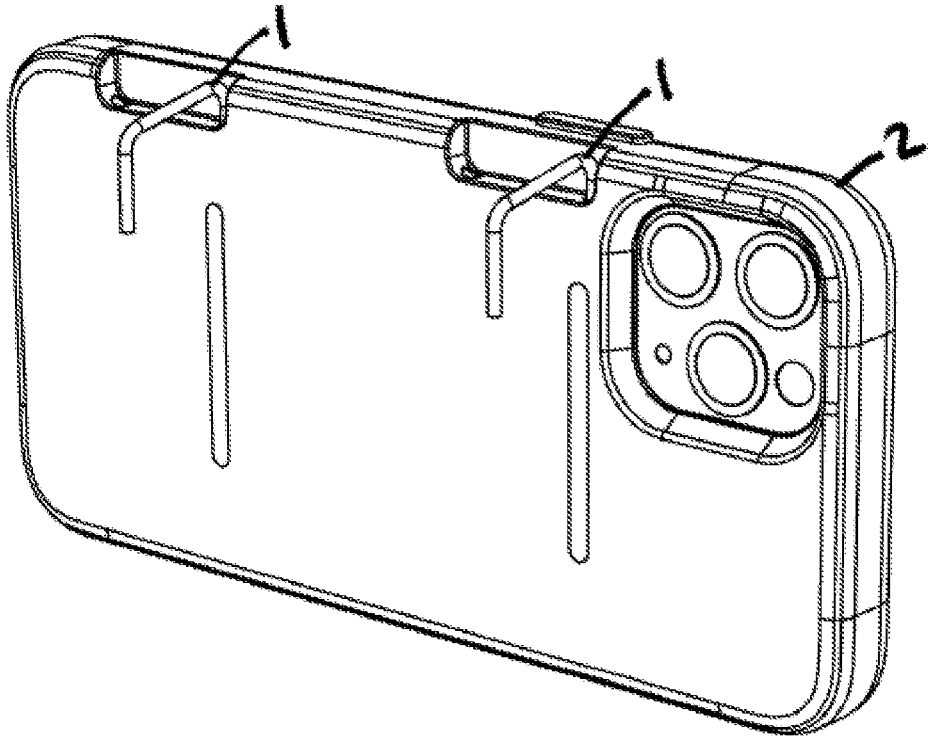
FIG. 1 shows a perspective view of an electronic device case having two extendable and rotatable hook members embedded within the case and rotated perpendicular to the case.
Figure 2:
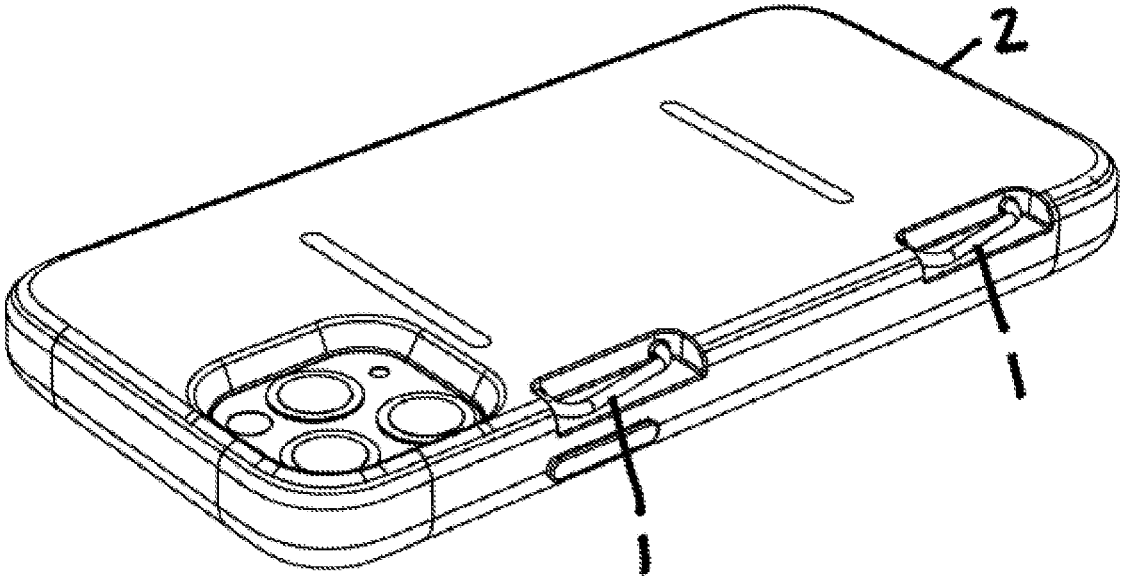
FIG. 2 shows a perspective view of the back of an electronic device case with two rotatable hook members stored within the case.
Figure 6:
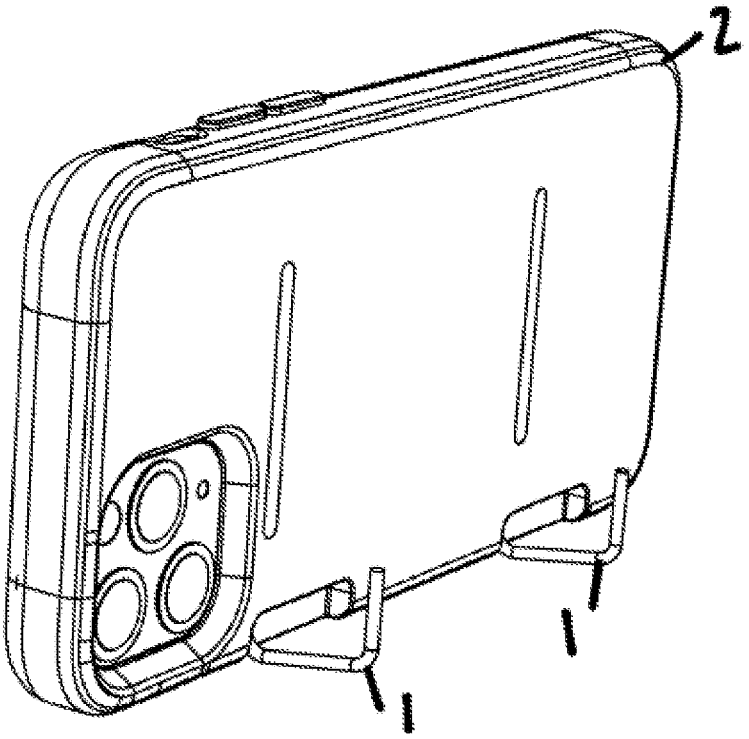
FIG. 6 shows a perspective view of an electronic device case with two rotatable hook members rotated perpendicular to the case and used as a stand for the electronic device.

The top ends of the hooks 1 are able to be extended from their first position, shown in FIGS. 1 and 2, wherein the hook 1 is contained internally within the case 2 and the top end engages at least one edge of the case 2 to their second position. The hooks 1 are extended to their second position wherein the top end of the hook 1 is extended away from the edge of the case 2 while the bottom end of the attachment member 1 remains internally within the case 2 as shown in FIG. 3. While in their second position, the hooks 1 can be rotated to be perpendicular with the edge of the case 2 as shown in FIG. 3. A swivel stop pin may be attached to the bottom end of the hook 1 which allows the hook 1 to be locked into place. The case 2 can then be hung as shown in FIG. 3. The hooks 1 may also be used as a stand for the device as shown in FIG. 6. To be stored, the hooks 1 are rotated to be parallel with the case 2 as shown in FIG. 5 and then pushed into the case 2.

Figure 7:
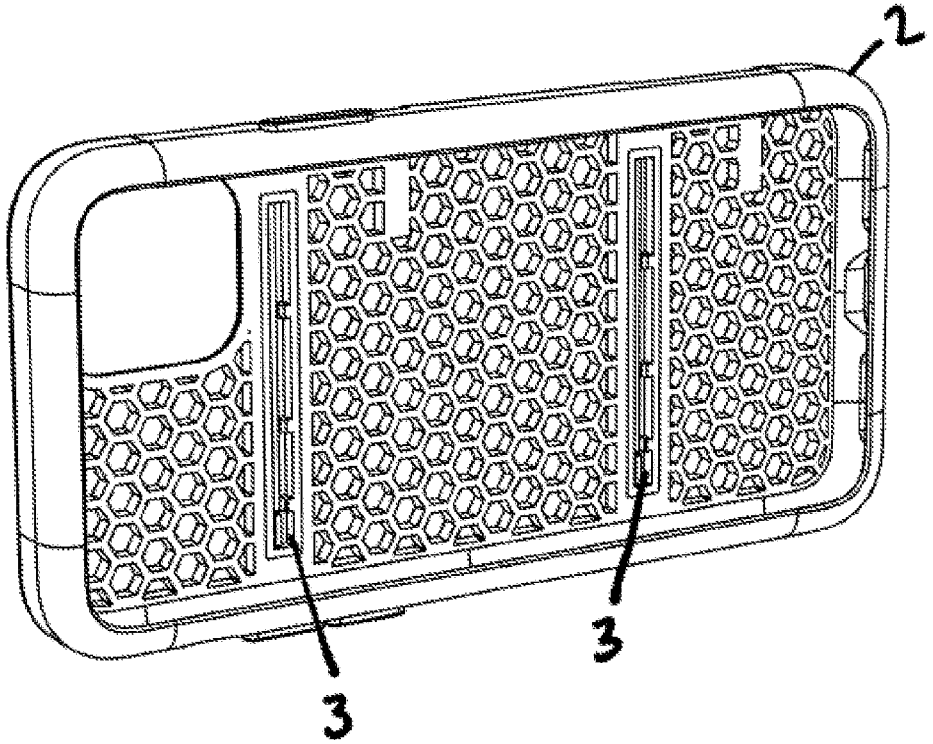
FIG. 7 shows the interior of an electronic device case with the rotatable hook members removed.

In one embodiment, the case 2 is formed by an injection molding process. During that process, the case 2 is molded with two long holes 3 in the core as shown in FIGS. 4 and 7. Uniform solid steel hooks 1 can then slide into the holes 3 in the core of the case 2. The hooks 1 are held in place using friction in this embodiment. Various materials may also be inserted into the holes 3 prior to the hooks 1 and or in the injection molding process in order to increase friction. Alternatively, a telescoping antenna type member may be glued into the mold of the case 2. This allows the hook 1 to extend and retract in a similar manner to an antenna and allows the extendable piece to maintain its position within the core of the case 2 using any traditional adhesive material.

Those of skill in the art will understand that various details of the invention may be changed without departing from the spirit and scope of the invention. Furthermore, the foregoing description is for illustration only, and not for the purpose of limitation, the invention being defined by the claims. For example, while the attachment members in the drawings are hooks, the attachment members can be comprised of various shapes and materials including, but not limited to, loops, magnets, and Velcro. Further, the material to be used for the case may be any material suitable for protecting an electronic device.

All references cited in this specification are incorporated herein by reference to the extent that they supplement, explain, provide a background for or teach methodology or techniques employed herein.

What is claimed is:

1. An electronic device case comprising:

a case configured to accommodate an electronic device in a shape surrounding a rear surface and side surfaces of an electronic device;

the case having:

an electronic device engaging surface;

an opposing exterior surface;

a core intermediate the electronic device engaging surface and the opposing exterior surface;

at least one attachment member having a top end and a bottom end and a straight shaft having an axis connecting the top and bottom ends the top end comprising a lateral portion and a tip portion;

wherein the attachment member is rotatable; and wherein the attachment member is movable between:

a first position wherein the straight shaft and the tip portions of the attachment member are substantially within the core and covered by the opposing exterior surface;

a second position wherein:

the top end of the attachment member extends from the core; and the bottom end of the attachment member is within the core;

by axially moving the straight shaft along its axis.

2. The electronic device case of claim 1 wherein:

the top end of the attachment member comprises a hook.

3. A method of hanging an electronic device for viewing, comprising:

providing an electronic device case comprising:

a case configured to accommodate an electronic device in a shape surrounding a rear surface and side surfaces of an electronic device;

the case having:

an electronic device engaging surface;

an opposing exterior surface;

a core intermediate the electronic device engaging surface and the opposing exterior surface;

at least one attachment member having a top end and a bottom end and a straight shaft having an axis connecting the top and bottom ends the top end comprising a lateral portion and a tip portion;

wherein the attachment member is rotatable; and wherein the attachment member is movable between:

a first position wherein the straight shaft and the tip portions of the attachment member are substantially within the core and covered by the opposing exterior surface;

a second position wherein:

the top end of the attachment member extends from the core to allow an electronic device within the case to hang from the attachment member; and the bottom end of the attachment member is within the core by axially moving the straight shaft along its axis;

providing an electronic device suitable to fit within the case;

fitting the electronic device into the case;

moving the attachment member from the first position to the second position;

hanging the attachment member of the case from a surface such that the electronic device is oriented for viewing.

4. The method of hanging an electronic device for viewing of claim 3 wherein:

the top end of the attachment member comprises a hook.

5. A method of orienting an electronic device for viewing, comprising:

providing an electronic device case comprising:

a case configured to accommodate an electronic device in a shape surrounding a rear surface and side surfaces of an electronic device;

the case having:

an electronic device engaging surface;

an opposing exterior surface;

a core intermediate the electronic device engaging surface and the opposing exterior surface;

at least one attachment member having a top end and a bottom end and a straight shaft having an axis connecting the top and bottom ends the top end comprising a lateral portion and a tip portion;

wherein the attachment member is rotatable; and wherein the attachment member is movable between:

a first position wherein the straight shaft and the tip portions of the attachment member are substantially within the core and covered by the opposing exterior surface;

a second position wherein:

the top end of the attachment member extends from the core to allow an electronic device within the case to stand on the attachment member; and the bottom end of the attachment member is within the core;

by axially moving the straight shaft along its axis;

providing an electronic device suitable to fit within the case;

fitting the electronic device into the case;

moving the attachment member from the first position to the second position;

using the attachment member as a stand for the case such that the electronic device is oriented for viewing.

6. The method of orienting an electronic device for viewing of claim 5 wherein:

the top end of the attachment member comprises a hook.

* * * * *